United States Patent [19]

Kontz

[11] Patent Number: 4,851,072

[45] Date of Patent: Jul. 25, 1989

[54] LABEL APPLICATION APPARATUS HAVING A MAGAZINE WITH RETAINING FINGERS

[75] Inventor: Robert F. Kontz, Toledo, Ohio

[73] Assignee: Owens-Illinois Plastic Products Inc., Toledo, Ohio

[21] Appl. No.: 926,744

[22] Filed: Nov. 4, 1986

[51] Int. Cl.[4] ..... B65C 9/04; B65C 9/12

[52] U.S. Cl. ..... 156/453; 156/451; 156/564; 156/570; 156/573; 156/DIG. 13; 156/DIG. 26; 156/DIG. 30

[58] Field of Search ..... 156/451, 453, 569–570, 156/573, 564, 556, 448, 449, DIG. 12, DIG. 13, DIG. 26, DIG. 29–30, 457

[56] References Cited

U.S. PATENT DOCUMENTS

| | | | |
|---|---|---|---|
| 1,410,845 | 3/1922 | Stevens | 156/453 |
| 1,536,835 | 5/1925 | Fredsell | 156/570 X |
| 2,528,912 | 11/1950 | Rappaport et al. | 156/DIG. 27 X |
| 2,908,414 | 10/1959 | Fairest et al. | 156/451 |
| 3,215,582 | 11/1965 | Carter . | |
| 3,567,551 | 3/1971 | Dullinger | 156/457 X |

FOREIGN PATENT DOCUMENTS

| | | | |
|---|---|---|---|
| 0742551 | 9/1966 | Canada | 156/453 |

*Primary Examiner*—Michael W. Ball
*Assistant Examiner*—Jeff H. Aftergut

[57] ABSTRACT

Apparatus for applying labels to containers including a label application station having a label dispensing magazine for holding a stack of labels and releasing the end label of the stack through an opening formed in the magazine to a container. Means are provided for rolling containers past the magazine so that when a leading edge of an end label on a stack is adhered to a side of a container the label is rolled onto the container and withdrawn from the magazine. A plurality of retaining fingers extend in front of the magazine opening to retain the stack of labels in the magazine. Control arms associated with the retaining fingers are adapted to retract the retaining fingers out of label retaining position in response to contact with a container rolling past the magazine.

7 Claims, 3 Drawing Sheets

LABEL APPLICATION APPARATUS HAVING A MAGAZINE WITH RETAINING FINGERS

BACKGROUND OF THE INVENTION

1. Field of the Invention

This invention relates generally to label application apparatus and is particularly useful in roll-on label applying operations.

2. Description of the Prior Art

Labeling apparatus using a roll-on label operation is known in the prior art, for example in U.S. Pat. Nos. 3,183,138; 3,472,722 and 4,090,904. While such apparatus has been useful the machines have been complex, expensive and have required substantial maintenance. Moreover, as the preference for plastic polyethylene labels has grown, the development of apparatus of applying such labels has not kept pace within the context of providing relatively simple and inexpensive machines that can operate at desired label application speeds. In addition, the polyethylene labels themselves have special properties that make their use in some prior art machines difficult and/or that can be utilized in a new approach to more successfully apply such labels. In particular, a new approach for successfully dispensing individual labels to containers as they pass a dispenser was needed.

SUMMARY OF THE INVENTION

An improved label application system is disclosed which includes a label application station having a label dispensing magazine for holding a stack of labels and releasing the end label of the stack through an opening formed in the magazine to a container as the container passes the magazine. Means are provided for rolling containers past the magazine so that when a leading edge of an end label on a stack is adhered to a side of a container the label is rolled onto the container and withdrawn from the magazine as the container rolls past the magazine.

A plurality of retaining fingers extend in front of the magazine opening to retain the stack of labels in the magazine. Control arm means are associated with the retaining fingers. The control arm means are adapted to retract the retaining fingers out of label retaining position in response to contact with a container rolling past the magazine.

The container rolling means includes endless loop carrier means having a run spaced from and substantially parallel to the label release opening in the magazine. Bracket means are suspended from the carrier means and are configured to form a container receiving pocket. The bracket means have roller means mounted thereon to enable a container to rotate freely in the pocket. Means are provided for rotating a container in the pocket as the bracket move past the magazine. Back up means are positioned on the opposite side of the carrier run from the magazine for maintaining the run in a parallel relationship during its course past the magazine.

Means are provided for feeding containers to the container rolling means including supply conveyor means and means for metering the flow of containers from the supply conveyor to the container rolling means so that only one container is supplied as a bracket means passes the container feeding means. The metering means includes a screw feed conveyor.

The container rolling means further includes a deck extending from the container feeding means past the label application station for supporting containers rolled past the magazine. Guide means are positioned above the deck to insure that containers stay in the bracket pockets. The supply conveyor advantageously extends below the bracket carrier means to receive containers discharged from the label application station. Discharge guide rail means are provided, for the discharge portion of the supply conveyor, which extend into the path of the container rolling means to divert containers to the discharge portion of the supply conveyor.

It is an object of this invention to provide improved label application apparatus.

It is a further object of this invention to provide an. improved label dispensing apparatus for use in label application.

Other objects, advantages and features of the invention will become apparent when the following description is taken in conjunction with the accompanying drawings.

BRIEF DESCRIPTION THE DRAWINGS

In the drawings, where like numerals are employed to designate like parts throughout:

DESCRIPTION OF THE PREFERRED EMBODIMENT

Figure 1:
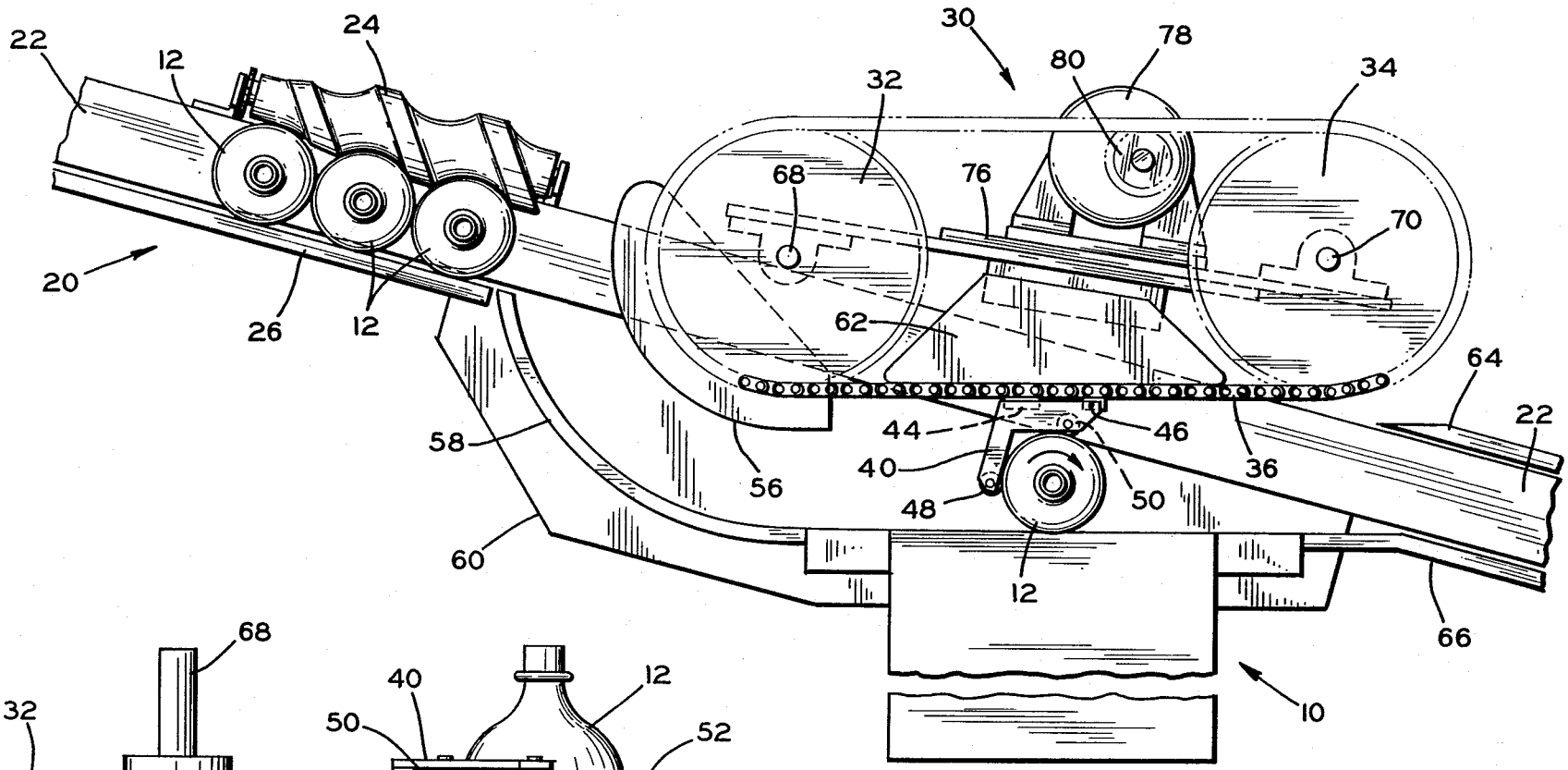
FIG. 1 is a plan view of label application apparatus embodying the teachings of this invention.

Referring now to the drawings there is illustrated an embodiment of the invention in which the object receiving a label is a container. While the container shown has a cylindrical body portion enabling it to be rolled by a magazine containing a stack of labels, it should be noted that the invention is applicable to objects of various shapes and mechanisms for rotating the object past the label dispensing magazine so that the label receiving surface is progressively applied to the label dispensing opening of the magazine to successively release the end label of the stack along its length.

FIG. 1 is a plan view of apparatus for successively applying labels from a magazine means generally indicated at 10 to a series of containers 12. The magazine means 10 is shown in greater detail in FIGS. 3, 4 and 5.

A container supply means is indicated generally at 20 and includes an input belt conveyor 22, a screw feed means 24 and input guide rail 26. The screw feed conveyor 24 in cooperation with guide rail 26 meters the flow of containers 12 to on off-loading mechanism generally indicated at 30 so that only one container 12 at a time is fed to the off-loading means 30 in synchronism with the individual bottle handling capacity of means 30.

The off-loading means 30 includes pairs of vertically spaced sprockets 32, 34 carrying upper and lower runs of endless loop carrier chains 36, 38. A plurality of pairs of upper and lower brackets 40, 42 connected by a vertical frame member 44 (best seen in FIG. 2) are pivotally connected at 46 to the upper and lower runs of chains 36, 38. A spring means (not shown) may be used to bias the trailing portion of each pair of brackets toward the chain runs, but yieldingly allowing the bracket pairs to swing away from the chain runs around the pivot means 46 allowing the bracket pairs to track around the curves of the sprockets without binding.

Figure 2:
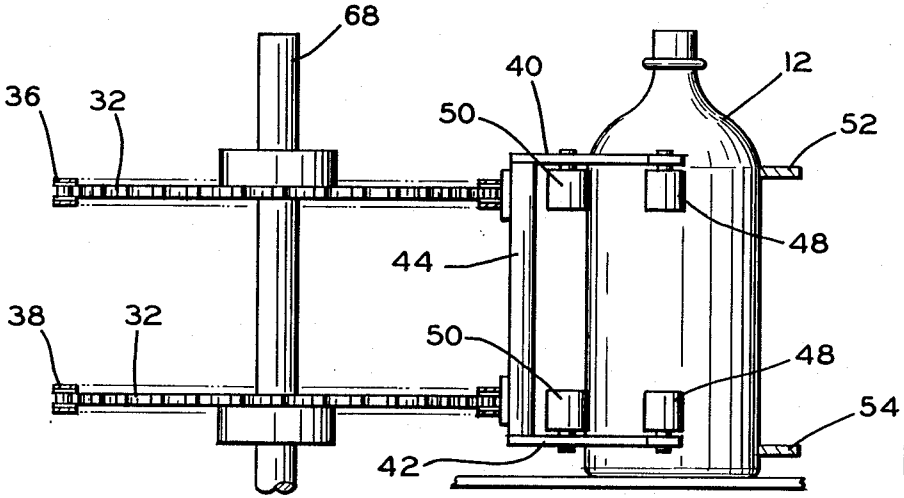
FIG. 2 is a side elevational view of a portion of the apparatus illustrated in FIG. 1.

Each of the brackets 40, 42 are substantially L-shaped and have upper and lower pairs of rollers 48, 50 pivotally connected thereto at the ends of the arms of each L-shape with the axis of each roller substantially parallel to the axis of a container with the configuration forming a container receiving pocket. One or more frictional rub rail means 52, 54 (FIG. 2) cooperate with the bracket-roller combination to rotate the container about its axis as it passes in front of magazine means 10. The rub rail means 52, 54 may be separate elements as shown in FIG. 2 or frictional contact areas may be formed on the bottle contacting face of the magazine means 10 to ensure bottle rotation to roll a label from the magazine onto the container as described hereinafter.

Although only one pair of brackets 40, 42 is shown, there are to be a number of such pairs spaced around the endless loops of the carrier chains. The screw conveyor means 24 is driven at a speed designed to synchronize the delivery of a container 12 as a pair of such brackets arrives at the off-loading point from belt conveyor 22.

An input guide member 56 is positioned across belt conveyor 22 and has an arcuate bottle contacting surface that stops the container 12 on conveyor 22 in a position to be picked up by the container receiving pocket of brackets 40, 42. The arcuate surface of guide 56 then assists in guiding a container 12 in cooperation with guide rail 58 until the container 12 reaches a travel path which is substantially parallel with a label dispensing opening in magazine means 10. A container support deck 60 is positioned adjacent to and on the same level with conveyor belt 22 to support containers 12 until they are returned to a discharge section of conveyor 22.

At least one back-up member 62 is positioned on the opposite side of the carrier run 36 from the magazine means 10 to ensure that this portion of the run is maintained in a substantially parallel relationship during its course past the magazine. A similar back-up member may be used in the same position for the lower carrier run 38.

After a container passes the magazine 10 it is conveyed by brackets 40, 42 onto the discharge portion of conveyor 22 to deliver the containers to the next operation. A guide rail 64 extends into the path of a container leaving the label application station at magazine 10 to ensure that containers are diverted onto conveyor 22. Guide rail 66 cooperates with rail 64 to maintain the containers on conveyor 22.

In a manner known in the art sprocket pairs 32, 34 may be mounted on vertical shafts 68, 70 which are journally mounted in bushing or bearing means carried on frame means 76. A motor supported on frame 76 rotates sprocket means 80 through a gear reduction mechanism to drive the endless loop chains 36, 38. Sprocket means 80 may include two sprockets meshed with chains 36, 38, or only be meshed with one of the endless chain loops since sprocket pairs 32, 34 are fixedly secured to shafts 68, 70 and the rotation of one chain loop will cause the other loop to rotate. The screw feed conveyor means 24 is preferably also driven by motor 78 by suitable means well known in the art so that its operation is synchronized with the travel of container receiving pockets on chains 36, 38.

Figures 3, 6, 7, 8:
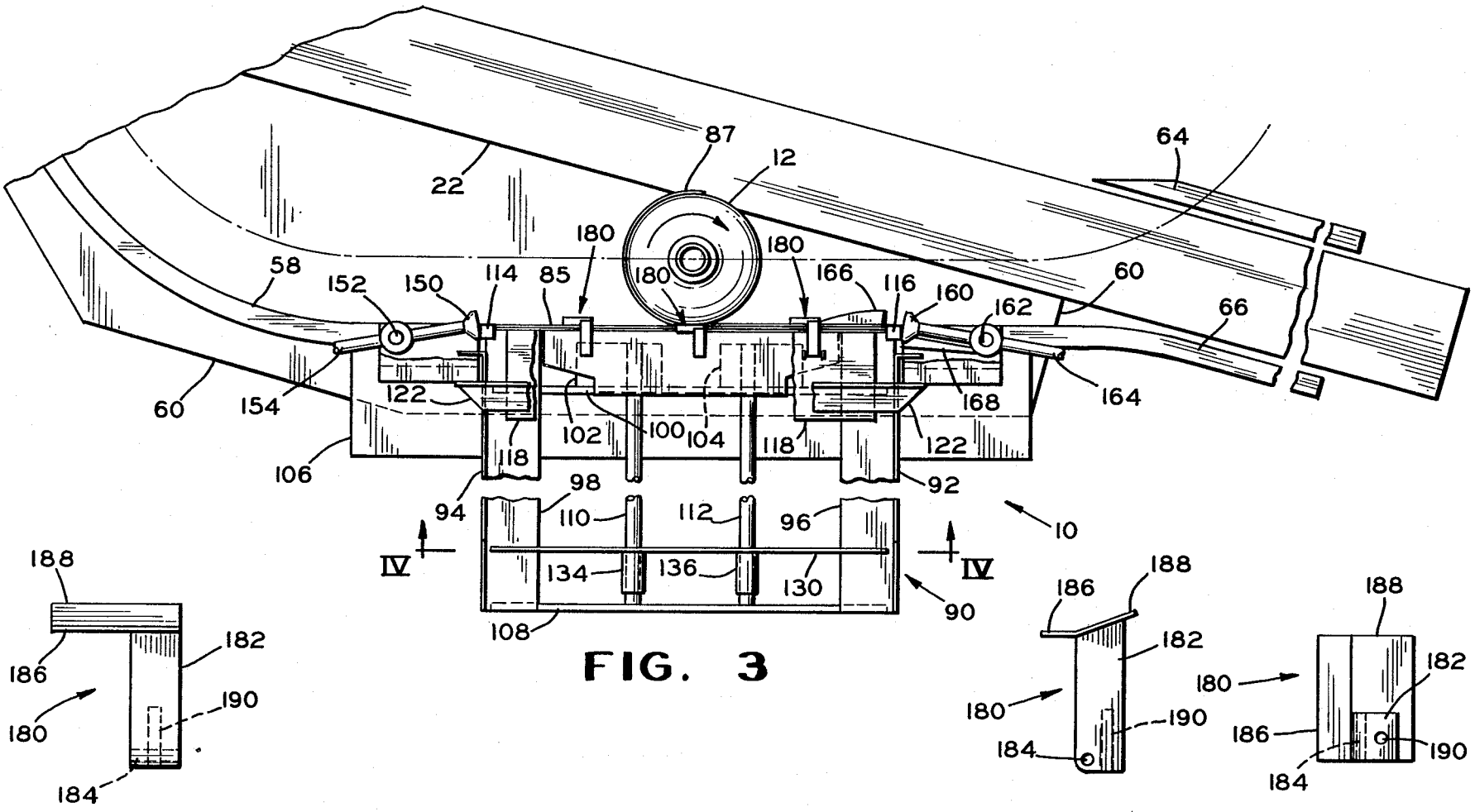
FIG. 3 is an enlarged view of label dispensing means utilized with the apparatus of FIG. 1.
FIG. 6 is an enlarged bottom view of means for releasably engaging labels in the dispenser shown in FIGS. 3, 4 and 5.
FIG. 7 is a side elevational view of the element illustrated in FIG. 6.
FIG. 8 is an end elevational view of the element illustrated in FIGS. 6 and 7.
Figure 4:
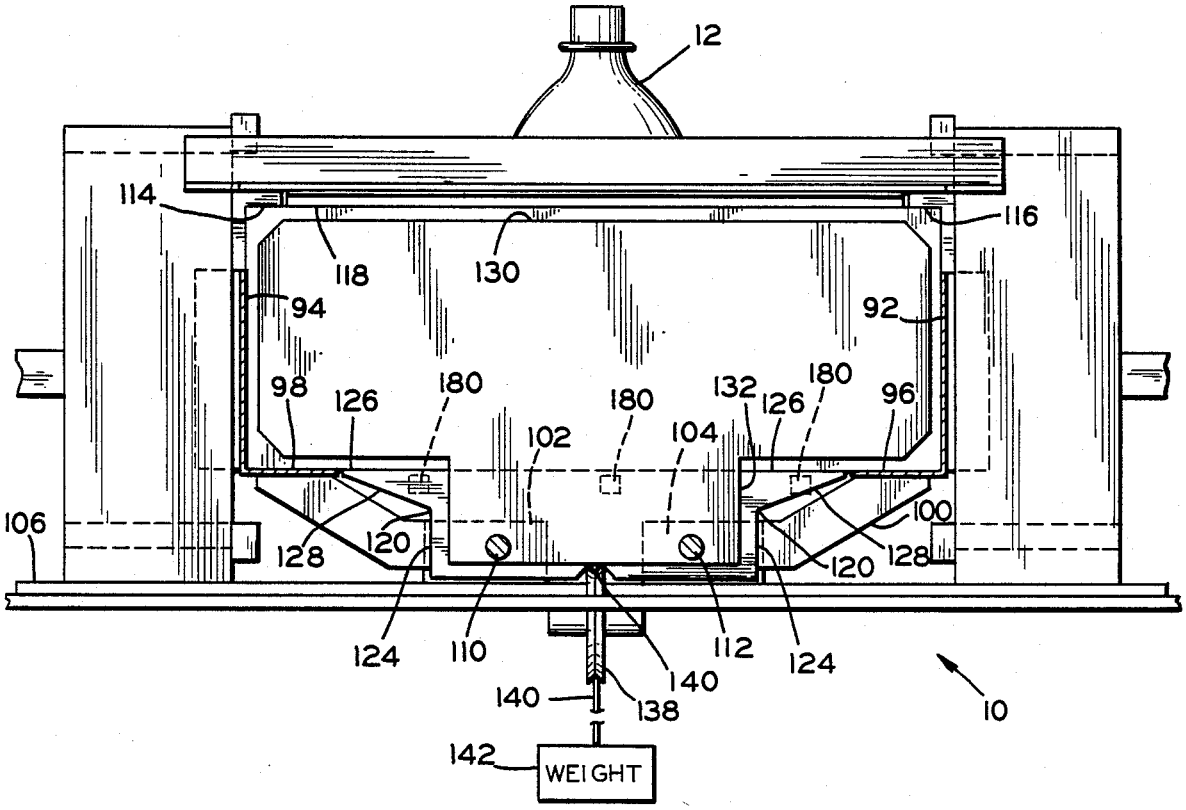
FIG. 4 is a cross-sectional view of the apparatus illustrated in FIG. 3, taken along lines IV—IV of FIG. 3.
Figure 5:
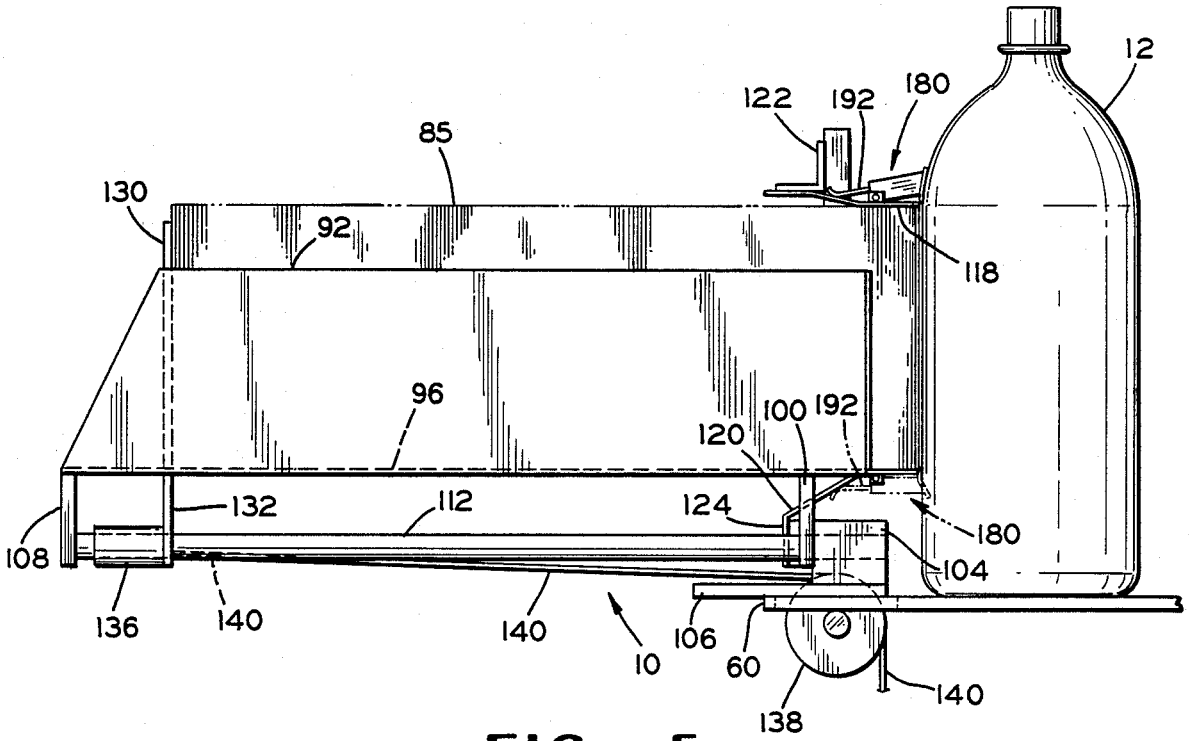
FIG. 5 is a side elevational view of the apparatus illustrated in FIGS. 3 and 4, with portions omitted to clarify the layout and operation thereof.

Referring now to FIGS. 3, 4 and 5 there is illustrated in more detail the magazine means indicated generally at 10 in FIG. 1. A stack 85 of rectangular flat labels are carried in tray means indicated generally at 90 formed by side walls 92, 94 having bottom walls 96, 98 connected thereto and extending toward each, but leaving a slot therebetween for a purpose to be described hereinafter. A forward yoke-shaped tray support member 100 is attached to bottom walls 96, 98 at opposite ends of and above member 100, while the member 100 is attached to slide rod support blocks 102, 104 resting on and attached to magazine support plate 106 which is secured to container slide deck 60. A tray support member 108 is attached to the bottom tray walls 96, 98 at the rear of tray 90. A pair of parallel slide rods 110, 112 are supported by and extend between blocks 102, 104 and rear tray support member 108.

A front opening in the magazine 10 is defined by front side posts 114, 116, a top opening plate 118 (which is partially broken away in FIG. 3 to more clearly show elements below it), and bottom opening plate 120. The front posts 114, 116 have inwardly extending upper sections that terminate adjacent top opening plate 118. The top opening plate 118 is supported from cross member 122 and has a rear edge that is higher than the forward edge which defines the opening, with the two edges being connected by a declining surface to guide misaligned labels into the opening of the magazine. The bottom opening plate 120 is supported on the frame adjacent to and surrounding the slide rods 110, 112 by a rear downwardly depending section 124. The forward portion 126 defines the bottom of the magazine opening and the upper surface thereof is on the same plane as the upper surfaces of bottom walls 96, 98 of tray 90. An inclined surface 128 connects rear and forward sections 124, 126 of plate 120 and urges any misaligned or sagging bottom edges of labels upwardly. The magazine opening just described is substantially the same size as the labels to be dispensed from stack 85.

A pusher plate 130 is provided to push the stack 85 towards the magazine opening as labels are dispensed. A downwardly depending tab 132 of plate 130 extends between bottom walls 96, 98 and is attached to bushings 134, 136 which are slidably mounted on rods 110, 112. A pulley 138 is rotatably mounted below the tray 90 in slots formed in deck 60 and magazine support plate 106. A cable 140 has one end secured to pusher plate tab 132 (best seen in FIG. 5) and runs back to and over pulley 138 and downwardly to a weight 142 (FIG. 4) or other means for yieldingly urging the pusher plate 130 forwardly.

Means are provided for adhering the leading and trailing edges of an end label on stack 85 to a container 12 being rolled past the magazine opening. The preferred label for use with this invention is formed from a cellular polymeric material such as a foamed polystyrene, although labels made from other materials may be used. The foamed polystyrene is thermoplastic and is adapted to be rendered adhesive by the application of heat to make the container contact surface of the label tacky to stick to the container when it is rolled over the heated label.

A hot air nozzle 150 (FIG. 3) is pivotally mounted at 152 and receives hot air through supply duct 154 to heat the leading edge of a label on stack 85 to adhere to a container 12 being rolled by magazine 10. The nozzle 150 is pivoted out of the way by a passing container but is normally biased toward the label heating position shown by suitable means not shown here. The pressure of the container 12 against the tacky label causes the label to adhere to the container 12 and to wrap around the container as it is rolled past the magazine.

Similarly, a hot air nozzle 160 is pivotally mounted at 162 and receives hot air through supply duct 164 to heat the trailing edge of the end label on stack 85 so that the trailing edge will adhere to the container 12 or to an overlap of the leading edge. The nozzle 160 is normally biased toward the label heating position shown, with a cam 166 in the path of bottle 12 and connected to nozzle 160, arm 168 being operative to pivot nozzle 160 out of the path of container 12.

Although hot air heating has been shown as useful with the preferred foam plastic labels, it is to be understood that other means for adhering both the foam plastic labels and labels made from other materials to containers 12. Such adhering means are disclosed in the prior art and may include hot melt glue guns, adhesive wheels, etc.

Referring now to FIGS. 6, 7 and 8 there is shown bottom, side elevational and end views of means 180 for releasably engaging the end label of the stack 85. A support arm 182 has a pivot pin bore 184 formed therein, and has a retaining finger 186 that normally extends in front of the magazine opening to engage and retain the end label of stack 85. A control arm 188 is associated with the retaining finger 186 and extends longitudinally along the path of a container 12, with a first edge (connected to retaining finger 186) outside of the container path and a second edge normally lying within the container path thus providing an inclined surface to receive container contact. A bore 190 in the support arm is formed to receive a wire spring 192 (FIG. 5) to yieldingly urge fingers 186 into label engaging and control arms 188 into container contacting positions.

The releasably engaging means are preferably mounted or disposed in pairs opposite each other across the width of the magazine opening and parallel to the axis of a container passing the opening to receive a label, thereby providing successive release points along the length of an end label on said stack while retaining the remainder of that label in position until the container passes. See FIG. 5 showing an opposed pair, with the upper one of the pair being shown in an "open" position as a result of control arm contact with a container, and the lower one of the pair being shown in phantom in the normally "closed" and label engaging position. In FIG. 5, the upper one is shown as pivotally mounted on top opening plate 118 while the lower one is pivotally mounted on bottom opening plate 120.

There has thus been shown and described a magazine 10 for holding a stack of labels 85, with the magazine having an opening formed therein through which the labels are to be successively dispensed. A plurality of retaining fingers 186 normally extend in front of the magazine opening to engage and retain the end label of the stack in the opening, each finger being retractively mounted for movement out of and back into label retaining position. Control arm means 188 associated with the fingers 186 extend into the path of and are actuatable by an object or container passing the magazine opening to receive a label. The arm means 188 are connected to retract the retaining fingers 186 out of the label retaining position in response to contact with the container passing the magazine opening. The spring means 192 yieldingly urge the retaining fingers 186 and the control arm means 188 into the label retaining position.

The control arm means includes individual control arms connected to each retaining finger, thereby enabling an individual release of an end label at each retaining finger position. The retaining fingers 186 are preferably disposed in pairs opposite each other across the width of the magazine opening and parallel to the axis of the container passing the opening to receive a label, thereby providing successive release points along the length of an end label on the stack while retaining the remainder of that label in position until the container passes.

Each control arm 188 is carried on a support member or arm 182 which is pivotally attached to the magazine. The spring means 192 is carried by the support member and thus urges the support member to return the control arm into container contacting position and the finger 186 into label retaining position after passage of a container past the control arm.

The form of the invention herein shown and described is to be taken as illustrative only, and changes in the shape, size and arrangement of the components, parts or portions may be made without departing from the spirit and scope of the invention.

I claim:

1. Apparatus for applying labels to containers, comprising;

(a) a label application station including a label dispensing magazine means for holding a stack of labels and releasing the end label of the stack through an opening formed in said magazine means to a container as the container passes the magazine means, (b) endless loop carrier means having a run spaced from and substantially parallel to said label release opening of said magazine means, (c) bracket means suspended from said carrier means configured to form a container receiving pocket, said bracket means having freely rotating roller means mounted thereon to enable a container to rotate freely in said pocket, (d) frictional contact means for rotating a container in freely rotating roller means in a bracket pocket as the bracket moves past said magazine means; said endless loop carrier means, bracket means and frictional contact means comprising means for rolling containers past said magazine means to enable a label from said magazine means to be wrapped onto a container, (e) a plurality of retaining fingers extending in front of said magazine opening to retain the stack of labels therein and, (f) control arm means associated with said retaining fingers, said control arms being adapted to retract said retaining fingers out of label retaining position in response to contact with a container rolling past said magazine means.

2. Apparatus for supplying labels to containers at a label application station, comprising:

(a) a magazine for holding a stack of labels, said magazine having an opening formed therein through which the labels are to be successively dispensed, (b) a plurality of retaining fingers normally extending in front of said magazine opening to engage and retain the end label of the stack in said opening, each retaining finger being retractively mounted for movement out of and back into label retaining position, and (c) a control arm associated with each of said retaining fingers and extending into the path of and actuatable by engagement with a side wall of a container passing said magazine opening to receive a label, said control arm having a first edge outside of the container path past the magazine and a second edge normally lying within said container path thereby inclining the control arm into the path of the container, said first edge being connected to the associated retaining finger to retract said retaining fingers out of said label retaining position in response to contact with a side wall of a container passing said magazine opening.

3. Label supplying apparatus as defined in claim 2 which further includes means for yieldingly urging said retaining fingers into said label retaining position.

4. Label supplying apparatus as defined in claim 2 which further includes means for yieldingly urging said control arm means into the path of a container passing said magazine opening to receive a label.

5. Label supplying apparatus as defined in claim 2 in which said retaining fingers are disposed in pairs opposite each other across the width of said magazine opening and parallel to the axis of a container passing said opening to receive a label, thereby providing successive release points along the length of an end label on said stack while retaining the remainder of that label in position until the container passes.

6. Label supplying apparatus as defined in claim 2 in which each said control arm is carried on a support member pivotally attached to said magazine.

7. Label supplying apparatus as defined in claim 6 which further includes means for yieldingly urging each said support member to return the control arm carried thereon into container contacting position after passage of a container past said control arm.

* * * * *